United States Patent [19]

Yamashita

[11] 4,403,719

[45] Sep. 13, 1983

[54] TAPE FEEDING SYSTEM

[75] Inventor: Kyoichi Yamashita, Yokohama, Japan

[73] Assignee: Koyo-Jido-Ki Co., Ltd., Japan

[21] Appl. No.: 276,803

[22] Filed: Jun. 24, 1981

[30] Foreign Application Priority Data

Jul. 25, 1980 [JP] Japan ..... 55-101242

[51] Int. Cl.[3] ..... B65H 17/22

[52] U.S. Cl. ..... 226/188

[58] Field of Search ..... 226/2, 24, 27–30, 226/37, 181, 182, 188; 101/181, 224–233

[56] References Cited

U.S. PATENT DOCUMENTS 3,204,842 9/1965 Reimann ..... 226/27

3,806,012 4/1974 Roch ..... 226/2

3,841,216 10/1974 Huffman ..... 101/181

4,129,238 12/1978 Herd ..... 226/29

*Primary Examiner*—Leonard D. Christian

*Attorney, Agent, or Firm*—Armstrong, Nikaido, Marmelstein & Kubovcik

[57] ABSTRACT

An adjustable high speed marked tape-feeding system which includes a larger drum and a smaller drum having greater circumferences than a predetermined length of tape arranged in tangential contact for transporting tape therebetween, a variable diameter drum adapted to rotate at a constant speed and a transmission mechanism for selectively connecting the variable diameter drum to either one of the other drums. A control system controls the diameter of the variable diameter drum and the transmission mechanism to speed up or slow down the tape transport depending upon whether the tape is being overfed or underfed.

6 Claims, 10 Drawing Figures

TAPE FEEDING SYSTEM

BACKGROUND OF THE INVENTION

This invention relates to a tape feeding system and, more particularly, to a system for feeding a tape bearing repeating patterns printed thereon to a subsequent station, for example, a cutting machine where the tape is cut for each pattern.

Apparatus for feeding a tape from its roll at a constant speed for the purpose of printing or cutting are well known in the art. Such feeding apparatus generally use a drum rotating at a constant speed to pull the tape.

Generally, a tape is fed at a constant speed to a cutting machine operating at a constant rate where the tape is cut into sections of equal length. However, a problem arises when a tape has a series of repeating patterns printed thereon before it is fed to a cutting machine operating at a constant rate where it is cut into sections, each bearing one printed pattern. (Pattern-bearing sections are ready for use as labels, for example.) In such a case, however, constant feeding of the tape is undesirable because individual pattern-bearing sections of the tape are not exactly equal in length.

The factors which cause variations in length of individual pattern-bearing sections are: an accumulation of slight errors of the position of patterns on the tape during printing, an accumulation of expansion and/or shrinkage of the tape itself during printing, elongation of the tape resulting from high speed feeding under increased tension, the influence of humidity, the conditions under which the roll of tape is stored, slight slippage of tape and interference by the roll of tape occurring when the tape is taken out and the like. The difference between two pattern bearing sections adjoining each other or spaced apart a few sections is, of course, almost negligible or very slight; while a considerable difference is found between two sections spaced at a distance. Under these circumstances, if the tape is fed at a constant speed and cut to an equal fixed length, the actual position of cutting will accumulatively deviate from the desired cutting position just intermediate the adjacent patterns.

SUMMARY OF THE INVENTION

Therefore, an object of the present invention is to provide a tape feeding system wherein a tape having a series of repeating patterns printed thereon is fed at a high speed and accurately in one-by-one pattern to a cutting machine operating at a constant rate.

According to the present invention, there is provided a tape feeding system comprising:

larger and smaller drums having greater and lesser circumferences than a predetermined length of one section of a tape, respectively, and disposed in tangential contact for transporting the tape therebetween, a variable-diameter drum adapted to rotate at a constant speed, transmission means for selectively connecting the variable-diameter drum to either one of the larger and smaller drums; and control means for controlling the variable-diameter drum and the transmission means and capable of detecting whether the tape is overfed or underfed, whereby the diameter of the variable-diameter drum is reduced and the rotation of the larger drum depends on the smaller drum when the control means detects that the tape being transported between the larger and smaller drums is overfed, and the diameter of the variable-diameter drum is increased and the rotation of the smaller drum depends on the larger drum when the control means detects that the tape is underfed.

BRIEF DESCRIPTION OF THE DRAWINGS

These and other objects and advantages of the invention may be readily understood by referring to the following description and appended drawings in which.

DESCRIPTION OF THE PREFERRED EMBODIMENTS

Figure 5:
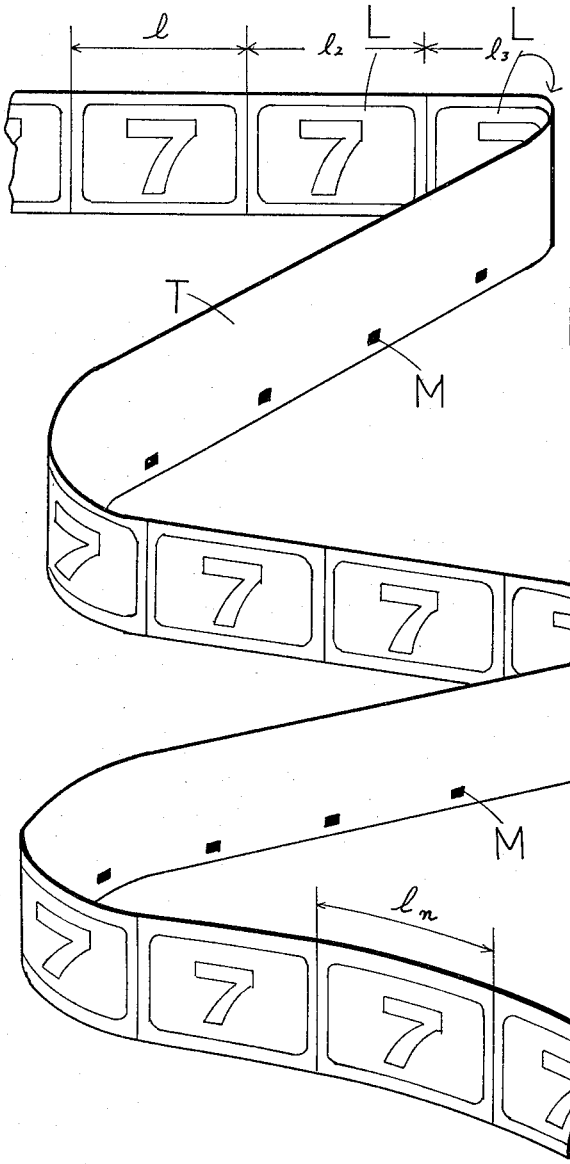
FIG. 5 is a perspective view of a tape having repeating patterns printed thereon.

First referring to FIG. 5, a tape T is illustrated in a serpentine form as having repeating patterns printed thereon. A section bearing one pattern is designated at L. The pattern-bearing sections L may be used as labels after cutting. One pattern-bearing section has a predetermined length l which is the ideal length of one section available when neither expansion/shrinkage of the tape nor printing error occurs. As described in the "Background" section of this application, the pattern-bearing sections have varying lengths due to pulling and other factors. Provided that pattern-bearing sections have actual lengths $l_1, l_2, l_3, \ldots, l_n$ from the leading edge in FIG. 5, the difference between two pattern-bearing sections adjoining each other or spaced part a few sections (that is, the difference between $l_1$ and $l_2$ or $l_3$) is almost negligible, but the difference between two sections spaced apart at a distance (that is, the difference between $l_1$ and $l_n$) is significant.

In addition to the repeating patterns, the tape also has check marks M printed on the back thereof at regular intervals which are initially set to be equal to the predetermined length l of one pattern-bearing section L. The distance from the leading side of one mark to that of the following mark is equal to the length of a corresponding section and hence, varied as the tape is transported.

Figure 1:
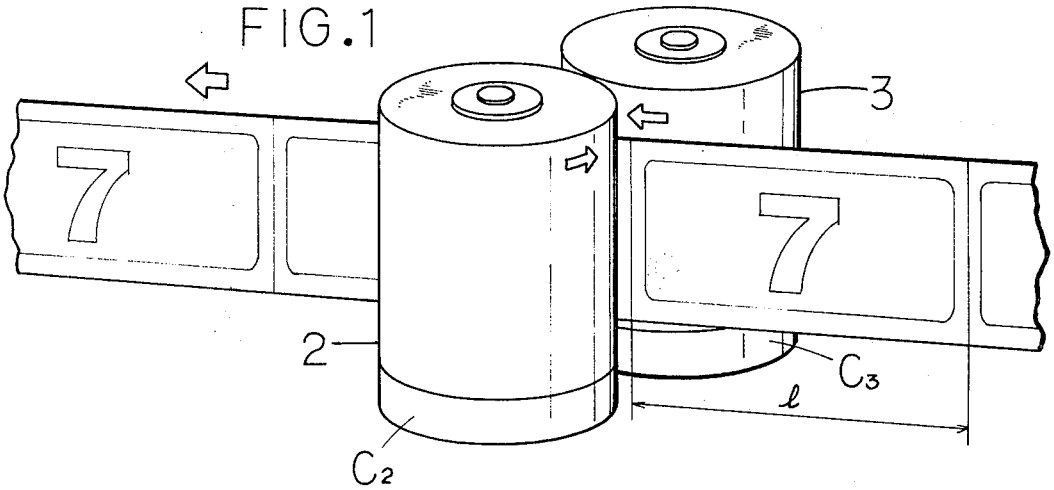
FIG. 1 is a perspective view of a pair of drums between which tape is transported.
Figure 2:
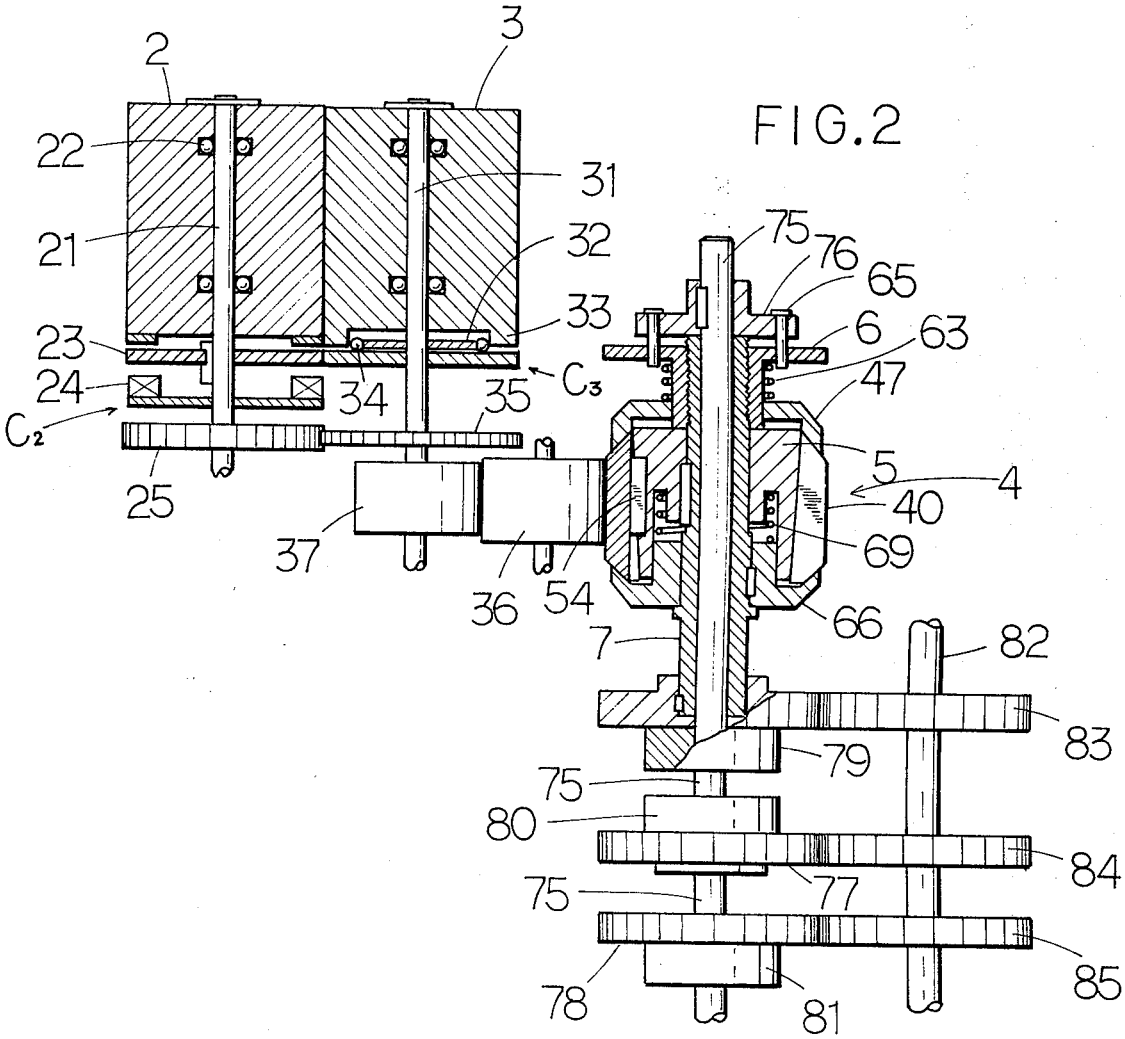
FIG. 2 is a partially cut-away elevational view showing an arrangement of a pair of larger and smaller drums and a variable-diameter drum.

A feed apparatus is illustrated in FIGS. 1 and 2 as comprising a pair of cylindrical drums 2 and 3 arranged in tangential contact with each other.

The first drum 2 has a circumference which is slightly greater than the predetermined length of one section cut from the tape or a label L and has a circumferential surface portion made of a material having a relatively high coefficient of friction, such as rubber. The second drum 3 has a circumference which is slightly less than the length of the label L and has a circumferential surface portion made of a material having a lower coefficient of friction than that for the first drum 2. The first and second drums 2 and 3 are referred to as larger and smaller drums, hereinafter. Since the predetermined length of a pattern-bearing section or label L is l, the larger drum 2 has a circumference of (l+d), while the smaller drum 3 has a circumference of (l−d) wherein d is a preselected difference.

As seen from FIG. 2, the larger drum 2 is mounted for free rotation on a drive shaft 21 which is rotated at a constant speed by means of a drive motor (not shown) through a transmission mechanism to be described hereinafter. Also mounted on the drive shaft 21 is an electromagnetic clutch $C_2$ which serves to transmit the driving force from the shaft 21 to the larger drum 2. The electromagnetic clutch for the transmission of driving force may be any of well-known clutch mechanisms and the typical construction thereof is shown in FIG. 2 by way of illustration but not for limitation.

In the illustrated embodiment, the larger drum 2 is mounted on the drive shaft 21 via bearings 22 for free rotation. Below the larger drum 2, a clutch disc 23 is mounted for axial motion on the drive shaft 21. However, the disc 23 is restrained with respect to the drive shaft 21 in a direction of rotation. The disc 23 always rotates with the shaft 21.

Placed below the disc is an electromagnet 24 which is electrically associated with a photoelectric detector to be described below. Energization of the electromagnet 24 urges the disc 23 upward into engagement with the drum 2. Then the driving force of the drive shaft 21 is selectively transmitted to the drum 2 through the disc 23 in response to an input to the electromagnet 24.

On the other hand, the smaller drum 3 is associated with a unidirectional clutch $C_3$. This clutch may be any of well known unidirectional clutch mechanisms and the typical construction thereof is shown in FIG. 2 by way of illustration but not for limitation.

In the illustrated embodiment, the smaller drum 3 is mounted for free rotation on a drive shaft 31 via bearings. The smaller drum 3 at the bottom has an annular rim 33 defining a circular recess. A gear 32 fixedly secured to the drive shaft 31 is received in the recess. A plurality of steel balls 34 are placed in spaces defined between the inner wall of the rim 33 and teeth of the gear 32. The rim 33 has a circular inner wall, while the teeth of the gear 32 are oriented and slanted in a direction opposite to the direction of rotation. The balls 34 are preferably biased by individual springs in the opposite direction. When the shaft 31 and the gear 32 rotates in the forward direction, the balls are firmly held between the slanted surface of the gear tooth and the inner wall of the rim 33. In this way, the driving force of the shaft 31 is transmitted to the rim 33 and hence to the smaller drum 3 via the gear 32 and the balls 34. It should be understood that with this arrangement, the smaller drum 3 is allowed to be forcedly rotated at a higher speed than the rotational speed of the drive shaft 31 in the same direction as the latter.

Drive gears 25 and 35 having the same number of teeth are fixedly secured to the drive shafts 21 and 31 for the larger and smaller drums 2 and 3, respectively, and mesh with each other so that the drive shafts 21 and 31 are rotated at the same speed. The drive shaft 31 is, in turn, driven by means of a variable diameter drum via intermediate rollers as described below.

Figure 3:
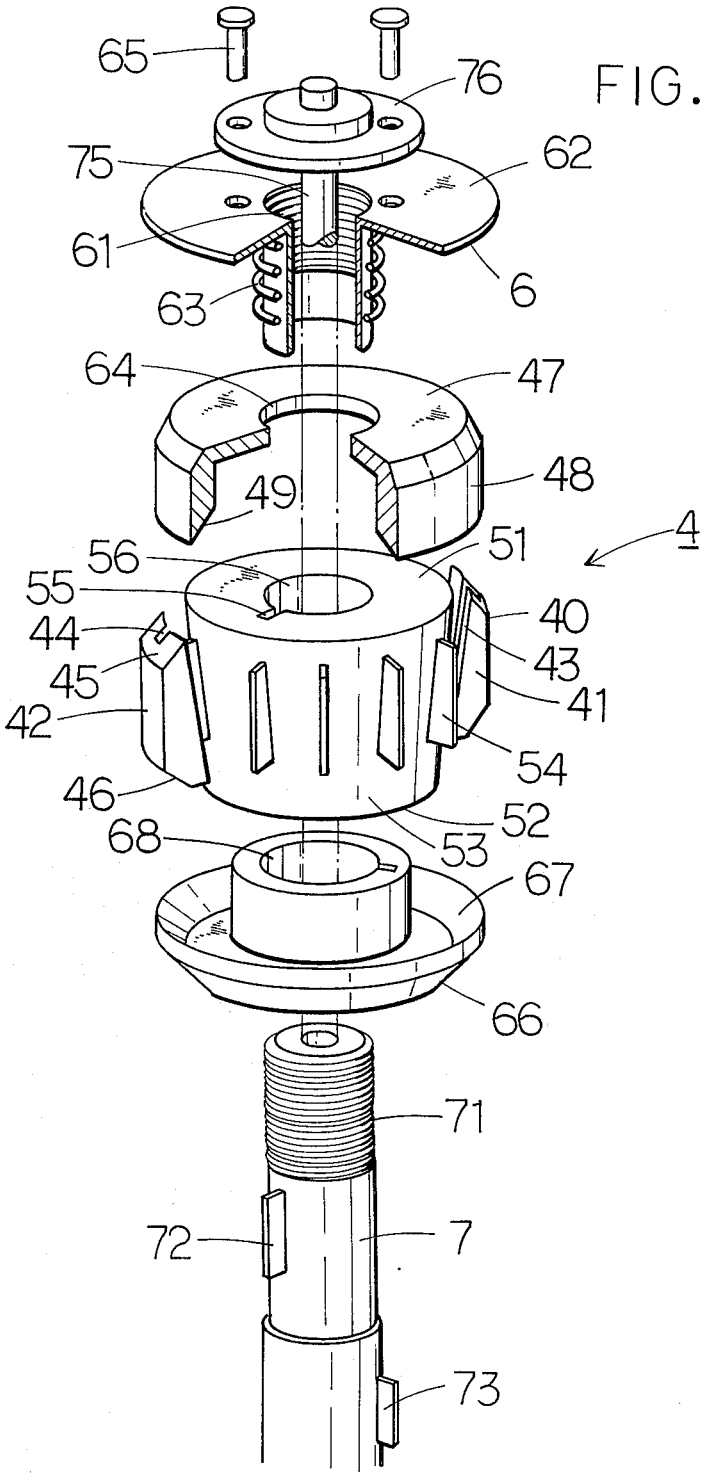
FIG. 3 is an exploded view of the variable-diameter drum.
Figure 4:
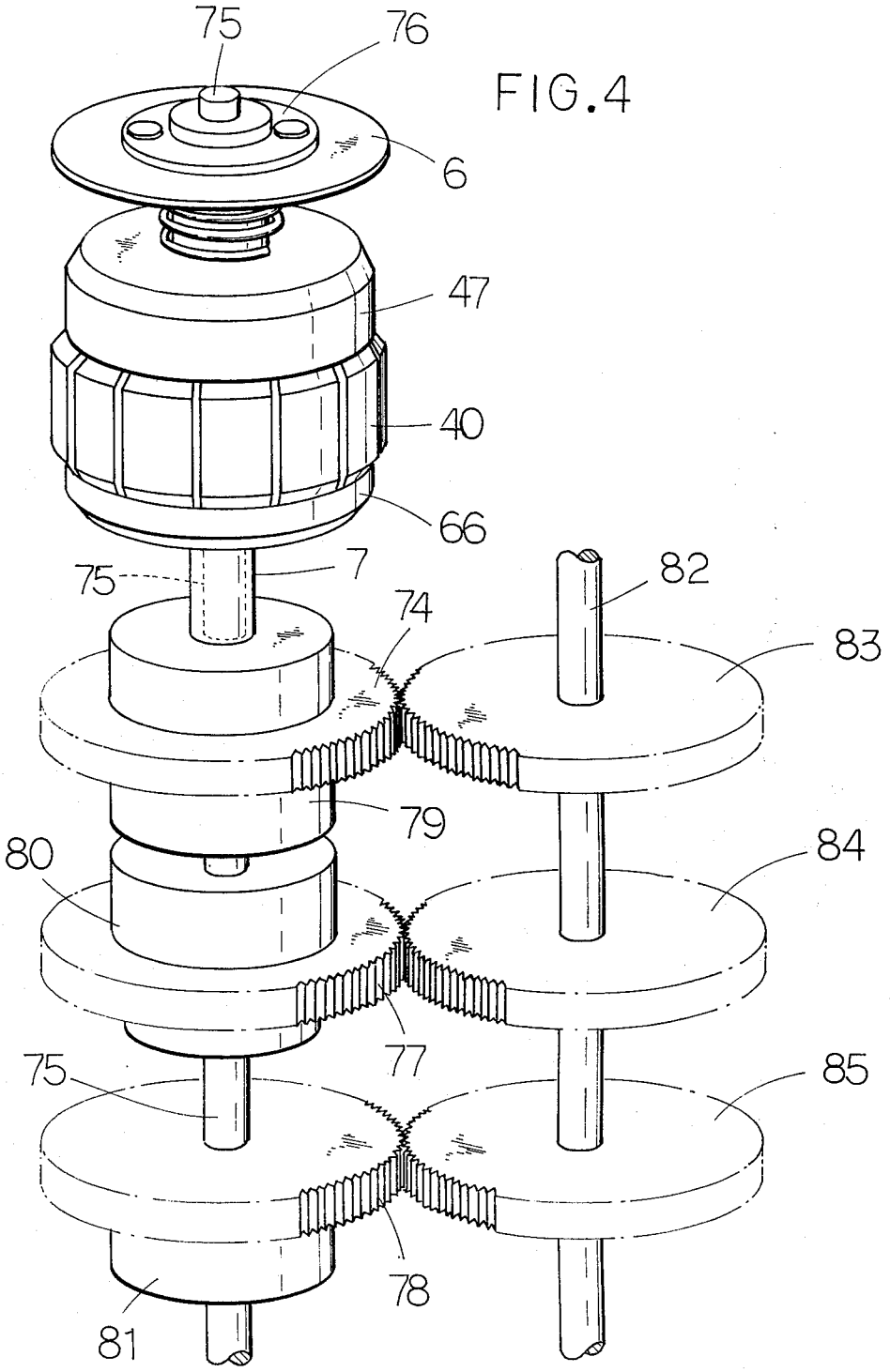
FIG. 4 is an exploded view showing gear mechanisms associated with the variable-diameter drum for changing the diameter thereof.

A diameter-variable drum 4 used in the system of the present invention is shown in FIGS. 2, 3 and 4 as comprising a sleeve shaft 7 having a core shaft 75 axially extending therethrough, a supporting ring 66 fixedly mounted on the sleeve shaft, a frusto-conical barrel 5 slidably mounted on the sleeve shaft above the supporting ring, a plurality of cylinder segments 40 circumferentially arranged around the frusto-conical barrel 5, a uniting ring 47 freely mounted on the sleeve shaft above the frusto-conical barrel and the cylinder segments, and a collar 6 screwed on the sleeve shaft above the uniting ring. These members have a common axis.

The cylinder segments 40 are obtained by dividing a hollow cylinder along a plurality of axially and radially extending planes. The segments 40 each have two cut or side surfaces 41 extending along different adjoining dividing planes, an outer arc surface 42, an inner arc surface 43, an outwardly bevelled upper surface 45 and an outwardly bevelled lower surface 46. The segments 40 form an integral cylinder when they are joined together with the adjoining side surfaces 41 abutting one another. The outer arc surfaces 41 of the joined segments form a continuous cylindrical outer surface which serves as a drum surface. On the other hand, the inner arc surfaces 43 of the joined segments form a continuous conical inner surface which is axially upwardly diverged. The segment 40 is provided with a channel 44 axially extending through the segment at the center of the arc inner surface 43. The upper surface 45 intersects with the outer surface 42 at an obtuse angle. The outwardly bevelled upper surfaces 45 then form a continuous frusto-conical surface when the segments are joined together. This also applies to the outwardly bevelled lower surfaces 46.

The inverse frusto-conical barrel 5 has upper and lower circumferentially extending surfaces 51 and 52, the upper surface 51 being larger in diameter than the lower surface 52, and has a frusto-conical outer surface 53 which is axially upwardly diverged in conformity with the inner surface of the segments 40. The barrel 5 is provided at the outer surface 53 with a plurality of axially extending guide plates 54. The number of the guide plates 54 is equal to that of the segments 40. The outer edge of the guide plate 54 extends parallel to the axis, as does the bottom of the channel 44 in the segment 40. The guide plates 54 fit in the axial channels 44 in the segments 40, respectively, when the segments 40 are circumferentially arranged around the barrel 5. In addition, the barrel 5 is provided with an annular recess extending from the bottom 52 to an intermediate point along the axial length of the barrel for receiving a coil spring 69 therein.

A set of cylinder segments 40 and the barrel 5 are arranged between the upper uniting ring 47 and the lower support ring 66.

The uniting ring 47 is provided for the purpose of uniting the freely arranged segments 40 into an integral cylinder. The uniting ring 47 includes an annular rim 48 extending vertically downward from the outer periphery thereof, and having an inwardly bevelled lower surface 49. A concentric hole 64 is formed in the ring 47 through which the collar 6 passes. The inwardly bevelled lower surface 49 of the ring 47 is brought into close contact with the outwardly bevelled upper surfaces 45 of the segments 40 to join the segments together when the ring 47 is forced downward.

The lower support ring 66 on which a set of the cylinder segments 40 and the barrel 5 are arranged includes an annular rim extending vertically upward from the outer periphery thereof and having an inwardly bevelled upper surface 67. Specifically, and bevelled lower surfaces 46 of the segments 40 mate with the upper surface 67 of the support ring 66. A hole 68 is formed in the support ring 66 at the center through which the sleeve shaft 7 extends.

The sleeve shaft 7, which is driven by suitable drive means to be described below, has a threaded portion 71 at the top. A key portion 72 protrudes from the sleeve shaft 7 below the threaded portion and another key portion 73 protrudes below the key 72.

The support ring 66 is fixedly secured to the sleeve shaft 7 by means of the key 73. The frusto-conical barrel 5 is mounted on the sleeve shaft 7. Since the guide key 72 is in loose fit in an axial channel 55 in a central bore 56 of the barrel 5, the frusto-conical barrel 5 is axially slidable along the sleeve shaft 7. The oil spring 69 is seated between the bottom of the annular recess in the barrel and the upper surface of the support ring 66 such that the barrel 5 is always biased upward.

The collar 6 having a threaded bore 61 and a radially extending flange 62 is screwed on the threaded portion 71 of the sleeve shaft 7 and passes through the hole 64 in the uniting ring 47. A coil spring 63 is seated between the flange 62 and the ring 47. Since the uniting ring 47 is loosely mounted on the sleeve shaft 7 and placed over the cylinder segments 40 and the barrel 5, the uniting ring 47 is always biased against the segments 40 by the action of the spring 63.

A drum driving gear 74 is fixedly secured to the sleeve shaft 7 at the bottom. Accordingly, the drum 4 rotates as long as the gear 74 is driven.

The core shaft 75 passes through the bore of the sleeve shaft 7. The top portion of the core shaft 75 extends beyond the sleeve shaft 7 and a bushing 76 is keyed to the core top portion. The bushing 76 is secured to the collar 6 by means of a suitable fixture, for examples, bolts or pins 65.

The core shaft is provided at the cover portion with two gears and three electromagnetic clutches for adjusting the drum diameter.

The two gears, i.e., a gear 77 for increasing the diameter and another gear 78 for reducing the diameter of the variable-diameter drum 4 are mounted for free rotating on the core shaft 75. These gears are described in detail hereinafter.

Three electromagnetic clutches associated with the core shaft 75 are now described.

The electromagnetic clutches each include a friction disc D mounted on the core shaft 75, allowed for axial sliding motion, but restricted from rotation about the core shaft 75. The friction disc D is disposed adjacent the associated gear and an electromagnet E is disposed on the side of the friction disc D opposite to the gear. When the electromagnet E is energized, the friction disc D is slid along the core shaft 75 under the repulsive force of the induced magnetic field and engaged with the associated gear. The friction disc D in engagement with the gear serves to transmit driving force from the gear to the core shaft 75. The clutch for transmitting driving force to the core shaft may be actuated or released in response to an input signal to the electromagnet. Each of the three electromagnetic clutches 79, 80 and 81 is described in further detail.

The sleeve shaft 7 rotates at a constant speed as the gear 74 secured thereto is always rotated through meshing engagement with a gear 83 on a shaft 82 to be described below.

The synchromesh type clutch 79 serves to rotate the core shaft 75 at the same speed as the sleeve shaft 7.

The acceleration clutch 80, when actuated, serves to rotate the core shaft 75 at a higher speed than the sleeve shaft 7 rotating at a constant speed.

When the friction disc of the clutch 80 is is engagement with a gear 77 for drum diameter enlargement freely rotating about the core shaft 75, the rotation of the gear 77 is transmitted to the core shaft 75. Then the core shaft 75 rotates at a higher speed.

The deceleration clutch 81, when actuated, serves to rotate the core shaft 75 at a lower speed than the sleeve shaft 7 rotating at a constant speed.

When the friction disc of the clutch 81 is in engagement with a gear 78 for drum diameter reduction freely rotating about the core shaft 75, the rotation of the gear 78 is transmitted to the core shaft 75. Then the core shaft 75 rotates at a lower speed.

A driving shaft 82 connected to the driving shaft of a motor (not shown) extends parallel to the core shaft 75 and includes three gears 83, 84 and 85 secured thereto. The gear 83 meshes with the gear 74 fixedly mounted on the sleeve shaft 7 and has the same number of teeth as the gear 74. For example, both the sleeve driving gear 74 and the gear 83 have 100 teeth.

The gear 84 meshes with the drum diameter-increasing gear 77 and has a larger number of teeth than the gear 83. For example, the gear 84 has 101 teeth.

The gear 85 meshes with the drum diameter-reducing gear 78 and has a lesser number of teeth than the gear 83. For example, the gear 85 has 99 teeth.

As shown in FIG. 5, the tape T has repeating patterns printed thereon. In addition, marks M are printed on the back of the tape at regular intervals which are equal to the predetermined length l of one pattern-bearing section L.

The marks M have a width a in the longitudinal direction of the tape.

A pair of photoelectric tubes $R_1$ and $R_2$ are arranged parallel to the tape path and spaced apart from each other a distance D, which is longer than the predetermined length l between two adjoining marks, but shorter than the sum of this length l and the width a of a mark. This relationship is described as follows:

$$l<D<l+a$$

Each photoelectric tube has a light emitting and a light receiving section. This photoelectric tube is turned on to generate a signal when the light emitted from the light emitting section impinges on reflective portions on the tape surface where black marks (light absorbing portions) are absent and the light receiving section receives the thus reflected light. Such photoelectric tubes are commercially available. Any of conventional photoelectric tubes may be used herein as long as they can detect the presence or absence of black marks on the tape.

For the purposes of description, the photoelectric tubes $R_1$ and $R_2$ are referred to as upstream and downstream photoelectric tubes, respectively. An output signal of the upstream photoelectric tube $R_1$ which is generated in the presence of a mark at the position facing the tube serves to release the electromagnetic clutch $C_2$ associated with the larger drum 2 and to bring only the deceleration clutch 81 in mesh with the drum diameter-reducing gear 78 while releasing the remaining clutches 79 and 80.

On the other hand, an output signal of the downstream photoelectric tube $R_2$ serves to actuate the electromagnetic clutch $C_2$ associated with the larger drum 2 and to bring only the acceleration clutch 80 in mesh with the drum diameter-increasing gear 77 while releasing the remaining clutches 79 and 81.

Figure 7:
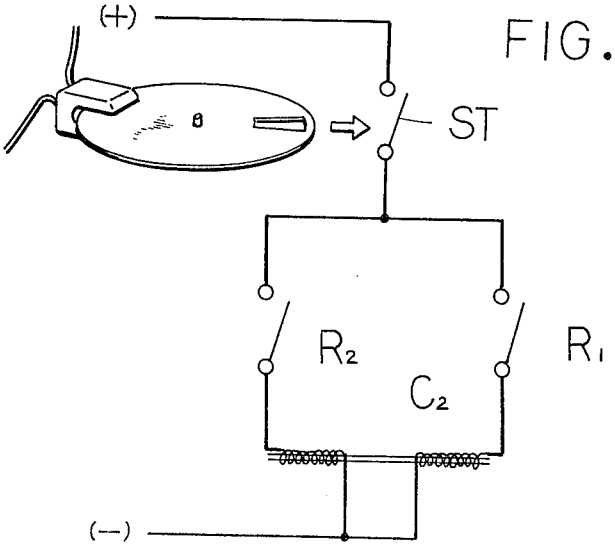
FIG. 7 is a diagram illustrating a signal transmission system.
Figure 8:
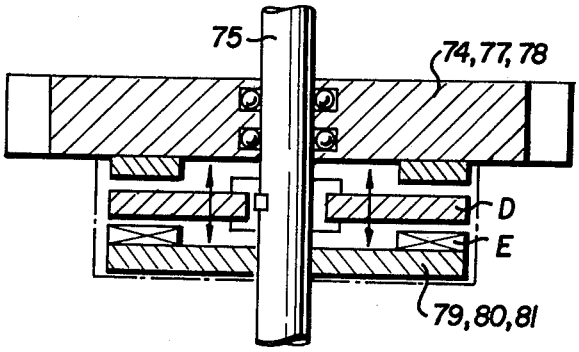
FIG. 8 is a cut-away elevational view of a structure of a typical electromagnetic clutch.

The photoelectric tubes $R_1$ and $R_2$ are not always energized, but once per revolution of the drums 2 and 3. To this end, a timing switch ST may be inserted between a power source and the photoelectric tubes as shown in FIG. 7. The timing switch ST may be in the form of another photoelectric detector combined with a rotating disc having a slit formed therein. The disc rotates at the same number of revolutions per minute as the driving shafts 21,31 of the drum 2,3. The timing switch ST is closed once per revolution of the drums 2 and 3 and, at this instant, the photoelectric tubes $R_1$ and $R_2$ are energized.

Driving force is transmitted from the variable-diameter drum 4 to the driving shaft 31 of the smaller drum 3, and hence to the driving shaft 21 of the larger drum 2 via intermediate rollers 36 and 37 preferably having an elastic surface layer, for example, a rubber layer.

The tape feeding system of the above arrangement operations as follows:

As long as the driving shaft 82 rotates, the variable-diameter drum 4 comprising the cylinder segments 40 and the sleeve shaft 7 is normally rotated at a constant speed via a synchromesh gear (including gears 83, 74 and clutch 79).

As described below, the diameter of the drum 4 may be increased or reduced by rotating the core shaft 75 at a higher or lower speed than the constantly rotating sleeve shaft 7.

Now the motor (not shown) is turned off to stop rotation of the driving shaft 82. The tape T is unwound from its roll and trained around some guide rollers (not shown), then between the drums 2 and 3, and finally to the subsequent working station (not shown), for example, a cutting blade.

At this point, the position of the photoelectric tubes $R_1$ and $R_2$ and the position of the slit in the timing disc as the timing switch ST are adjusted such that both the photoelectric tubes are aligned with corresponding marks M on the back of the tape and emit light when aligned.

After such adjustment has been completed, the power switch is turned on and then the driving shaft 82 starts rotating. The photoelectric tubes $R_1$ and $R_2$ are energized each time when two successive marks come into the positions facing the tubes. If the distance between two successive marks is within the allowable range, i.e., the predetermined length l of one pattern-bearing section plus/minus an allowable error, then the photoelectric tubes detect the presence of marks so that no output signal is available. In this condition, the synchromesh clutch 79 is in engagement with the drum driving gear 74, while the remaining clutches 80 and 81 are released. The core shaft 75 is rotated at the same speed as the gear 74. The core shaft 75 and the sleeve shaft 7 rotate at the same speed. No change occurs in the variable-diameter drum 4.

Figure 6A:
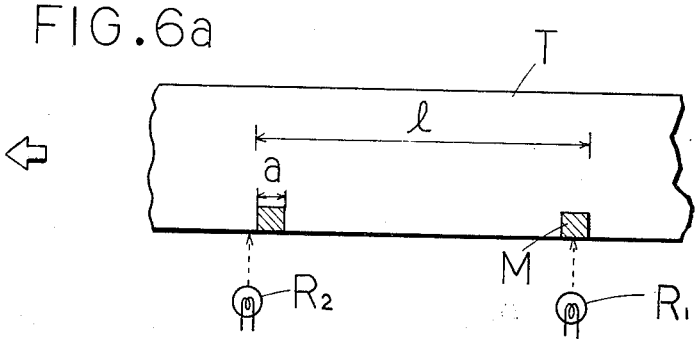
FIGS. 6*a*, 6*b* and 6*c* are detail views which illustrate the different positions of two successive marks on the tape relative to a pair of photoelectric detectors.
Figure 6B:
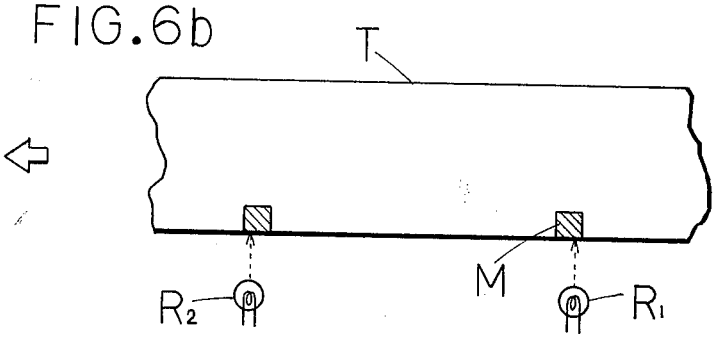
Figure 6C:
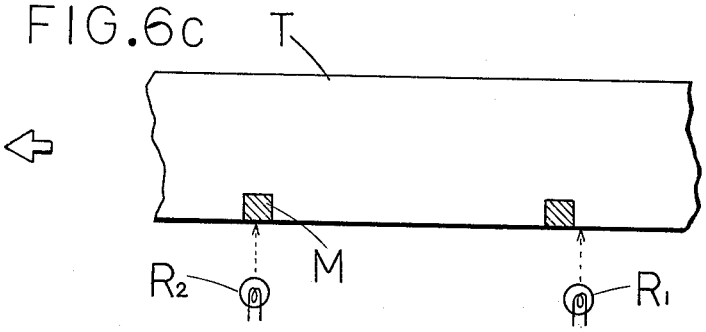

In this condition, the tape is fed at a rate defined by the larger drum 2 which has a circumference slightly greater than the predetermined length of one pattern-bearing section L. As the larger drum 2 continues to feed the tape, the tape is eventually overfed. The position of marks M with respect to the photoelectric tubes is illustrated in FIG. 6*c*. With the tape overfed, the trailing one of two successive marks goes beyond the detectable position shown by a dotted arrow. The upstream photoelectric tube $R_1$ generates an output signal as the emitted light is reflected by the unmarked tape surface.

This output signal is supplied to the electromagnetic clutch $C_2$ associated with the larger drum 2. The disc 23 is then disengaged from the drum 2, which becomes free from the driving shaft 21. As a result, the tape T is fed at a slower rate defined by the smaller drum 3 which is rotated by the driving shaft 31 via the unidirectional clutch $C_3$, which automatically comes in operational engagement after the forced rotation of the drum 3 by the drum 2 ceases.

The output signal of the upstream photoelectric tube $R_1$ further serves to bring the deceleration clutch 81 into engagement with the drum diameter reducing gear 78 while releasing the remaining clutches 79 and 80. As a result, the driving force is transmitted from the shaft 82 to the core shaft 75 via the lesser toothed gear 85. The core shaft 75 is thus rotated at a slightly lower speed than the constantly rotating sleeve shaft 7. This relative movement between the core shaft 75 and the sleeve shaft 7 causes the collar 6 to slowly rotate to a higher position on the shaft 7. The frusto-conical barrel 5 is raised by the action of spring 69. In accordance with the rising of the barrel 5, the cylinder segments 40 are joined closer as the uniting ring 47 urges them with the support ring 66 toward the center, reducing the diameter of the drum 4 smoothly.

As a result, the rotation of the shaft 31, and hence the smaller drum 3, is slightly slowed down. Accordingly, the feed rate of the tape is slightly slowed down. At the next detection instant, two successive marks come into alignment with the detectable positions as shown in FIG. 6*b*. Neither the photoelectric tube $R_1$ nor $R_2$ generates an output signal as the emitted lights are absorbed in the marks.

The smaller drum 3 continues to feed the tape for the time. The tape is fed at a slightly slower rate. Eventually, the tape is underfed. That is, the leading one of two successive marks comes behind the detectable position in alignment with the downstream photoelectric tube $R_2$ as shown in FIG. 6*a*. The downstream photoelectric tube $R_2$ generates an output signal as the emitted light is reflected by the unmarked tape surface.

This output signal is applied to the electromagnetic clutch $C_2$ associated with the larger drum 2. The disc 23 is brought into engagement with the drum 2, which comes into driving engagement with the driving shaft 21. The drum 2 is rotated by means of its own driving shaft 21. The smaller drum 3 follows the larger drum 2 as the unidirectional clutch $C_3$ allows the smaller drum 3 to follow the larger drum 2. (The smaller drum 3 is rotated at a higher speed than its driving shaft 31). The tape T is fed at a rate defined by the rotational speed of the larger drum 2.

The output signal of the downstream photoelectric tube $R_2$ further serves to bring only the acceleration clutch 80 into engagement with the drum diameter-increasing gear 77 while releasing the remaining clutches 79 and 81. As a result, driving force is transmitted from the shaft 82 to the core shaft 75 via the more-toothed gear 84. The core shaft 75 is thus rotated at a slightly faster speed than the constantly rotating sleeve shaft 7. This relative movement between the core shaft 75 and the sleeve shaft 7 causes the collar 6 to slowly rotate to a lower position on shaft 7. The frusto-conical barrel 5 is moved down by means of the collar 6. In accordance with the lowering of the barrel 5, the cylinder segments 40 are moved radially outwardly increasing the diameter of the drum 4 smoothly.

The enlarged configuration of the cylinder segments 40 is stable as the segments are held between the lower support ring 66 and the upper uniting ring 47 biased thereto by the spring 63 and prevented from random location by the mating bevelled surfaces.

The drum 4 with the thus increased diameter serves to rotate the driving shafts 21 and 31 at a faster speed via the intermediate rollers 36 and 37. At this point, the electromagnetic clutch $C_2$ is on as described above. The tape is thus fed at a rate defined by the rotational speed of the larger drum 2. The speed of rotation gradually increases until a signal representative of tape overfeeding is transmitted by the photoelectric tube $R_1$.

The operations described above are summarized as follows:

| Overfeed | | Underfeed | |
|---|---|---|---|
| (1) | Photoelectric tube $R_1$ detects. | (1') | Photoelectric tube $R_2$ detects. |
| (2) | Variable-diameter drum 4 reduces its diameter. Electromagnetic clutch $C_2$ of larger drum 2 is released. | (2') | Variable-diameter drum 4 increases its diameter. Electromagnetic clutch $C_2$ of larger drum 2 is actuated. |
| (3) | With reduced diameter of drum 4, the rotational speed of smaller drum 3 is rweduced. Larger drum 2 follows smaller drum 3. | (3') | With increased diameter of drum 4, the rotational speed of larger drum 2 is increased. Smaller drum 3 follows larger drum 2. |
| (4) | The tape feed rate is reduced. | (4') | Tape feed rate is increased. |

As described in the foregoing, in a tape feeding system according to the present invention, wherein larger and smaller drums are disposed in tangential contact for transporting a tape therebetween and adapted to be driven by means of a constantly rotating variable-diameter drum, the diameter of the variable-diameter drum is reduced and the rotation of the larger drum depends on the smaller drum when control means detects that the tape is overfed, while the diameter of the variable-diameter drum is increased and the rotation of the smaller drum depends on the larger drum when the control means detects that the tape is underfed.

When it is undesirable to feed a tape having repeating patterns printed thereon at a constant rate because pattern-bearing sections of the tape have slightly and gradually varying lengths due to expansion and/or shrinkage of the tape, accumulation of printing errors and the like, the tape can be transported at a high speed precisely one-by-one pattern-bearing section to a subsequent working station by using the tape feeding system of the present invention.

Since variations in the length of pattern-bearing sections are compensated for by a combination of a variable-diameter drum with a pair of larger and smaller drums, highly precise adjustment can be effected at a high speed.

What is claimed:

1. A tape feeding system comprising:

a larger drum and a smaller drum having greater and lesser circumferences than a predetermined length, respectively, and disposed in tangential contact for transporting tape therebetween;

a variable-diameter drum adapted to rotate at a constant speed;

transmission means for selectively connecting said variable-diameter drum to either one of said larger and smaller drums; and control means for controlling said variable-diameter drum and said transmission means and capable of detecting whether the tape is overfed or underfed, whereby the diameter of said variable-diameter drum is reduced and the rotation of said larger drum depends on said smaller drum when said control means detects that the tape being transported between said larger and smaller drums is overfed, while the diameter of said variable-diameter drum is increased and the rotation of said smaller drum depends upon said larger drum when said control means detects that the tape is underfed.

2. A tape feeding system according to claim 1 wherein said transmission means includes a first shaft adapted to be driven by means of said variable-diameter drum and axially extending through said larger drum and an electromagnetic clutch associated with said larger drum and first shaft for operatively connecting the larger drum to the first shaft when actuated.

3. A tape feeding system according to claim 1 or 2 wherein said transmission means includes a second shaft adapted to be driven by means of said variable-diameter drum and axially extending through said smaller drum and a unidirectional clutch associated with said smaller drum and second shaft for operatively connecting the smaller drum to the second shaft, but allowing the smaller drum to rotate at a higher speed than the second shaft.

4. A tape feeding system according to claim 1 wherein the tape has repeating patterns printed thereon and check marks printed on the back thereof at equal intervals, said control means includes a pair of photoelectric detectors capable of sensing the check marks on the tape and generating an output signal in the absence of a check mark at the corresponding position, said output signal being supplied to both said variable-diameter drum and said transmission means.

5. A tape feeding system according to claim 4 wherein:

said pair of photoelectric detectors are arranged upstream and downstream along the tape path; and an output signal of the downstream detector serves to reduce the diameter of said variable-diameter drum and to cause the rotation of said larger drum to depend on said smaller drum, while an output signal of the upstream detector serves to increase the diameter of said variable-diameter drum and to cause the rotation of said smaller drum to depend on said larger drum.

6. A tape feeding system according to claim 1 wherein:

the tape has repeating patterns printed thereon and check marks printed on the back thereof at equal intervals;

said transmission means includes a first shaft adapted to be driven by means of said variable-diameter drum and axially extending through said larger drum and an electromagnetic clutch associated with said larger drum and first shaft for operatively connecting the larger drum to the first shaft when actuated, and a second shaft adapted to be driven by means of said variable-diameter drum and axially extending through said smaller drum and a unidirectional clutch associated with said smaller drum and second shaft for operatively connecting the smaller drum to the second shaft, but allowing the smaller drum to rotate at a higher speed than the second shaft;

said control means includes a pair of upstream and downstream photoelectric detectors arranged along the tape path and capable of sensing the check marks on the tape and generating an output signal in the absence of a check mark at the corresponding position;

wherein output signals of the detectors are supplied to both said variable-diameter drum and said transmission means, an output signal of the downstream detector serves to reduce the diameter of said variable-diameter drum and to release the electromagnetic clutch while an output signal of the upstream detector serves to increase the diameter of said variable-diameter drum and actuate the electromagnetic clutch.

* * * * *